US006520789B2

(12) United States Patent
Daugherty, Jr. et al.

(10) Patent No.: US 6,520,789 B2
(45) Date of Patent: Feb. 18, 2003

(54) CONNECTING SYSTEM FOR PRINTED CIRCUIT BOARDS

(75) Inventors: Robert Earl Daugherty, Jr., Irvine, CA (US); Eric Dean Jensen, Irvine, CA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/862,749

(22) Filed: May 22, 2001

(65) Prior Publication Data

US 2002/0177345 A1 Nov. 28, 2002

(51) Int. Cl.[7] ..... H01R 13/62
(52) U.S. Cl. ..... 439/329; 439/67; 439/493
(58) Field of Search ..... 439/67, 329, 65, 439/492, 493

(56) References Cited

U.S. PATENT DOCUMENTS 3,221,286 A * 11/1965 Dedde ..... 29/604
4,057,311 A 11/1977 Evans
4,466,184 A 8/1984 Cuneo et al.
4,693,529 A * 9/1987 Stillie ..... 439/493
4,695,258 A 9/1987 Hanson et al.
4,850,883 A 7/1989 Kabadi
4,913,656 A 4/1990 Gordon et al.
5,160,269 A 11/1992 Fox, Jr. et al.
5,161,981 A 11/1992 Deak et al.
6,077,090 A * 6/2000 Campbell et al. ..... 439/67

* cited by examiner

*Primary Examiner*—Tho D. Ta
(74) *Attorney, Agent, or Firm*—Thomas N. Twomey

(57) ABSTRACT

A modular, snap-together clamping system for electrically interconnecting two printed circuit boards using a flexible circuit is provided. The clamping system comprises two inboard clamp members which are configured to cooperate with two generally complimentary outboard clamp members, so as to capture a portion of each of the printed circuit boards along with two end portions of the flexible circuit between the inboard clamp members and the outboard clamp members in a manner which facilitates electrical connection of each of the two printed circuit boards with the flexible circuit. The inboard clamp members are also configured to facilitate attachment of an interchangeable spacer thereto. The spacer is configured to facilitate desired positioning of the two printed circuit boards with respect to one another.

20 Claims, 9 Drawing Sheets

309
303
302
310
521
7
509
525
501
7
521
502
303
501
302
549
550
105
300
505
511
512
513
8
502
302
510
501
509
8
514
106
508
501
508
505
516
107
310
302
309

CONNECTING SYSTEM FOR PRINTED CIRCUIT BOARDS

FIELD OF THE INVENTION

This invention relates generally to electrical connectors and relates more particularly to modular electrical connectors for electrically interconnecting printed circuit boards and the like via a flexible circuit.

BACKGROUND OF THE INVENTION

Electrical connections are frequently made between flexible circuits and printed circuit boards. In many cases, flexible circuits are used to connect multiple printed circuit boards to one another.

A flexible circuit generally includes a flat, flexible substrate upon which electrical conductors or traces are formed. The electrical conductors typically terminate at end portions of the flexible circuit. Terminations formed at these end portions may comprise raised features such as conductive protuberances or bumps, which are used to effect electrical connection to corresponding contact pads formed upon a mating surface of a printed circuit board or the like. Such bumps typically comprise a malleable metal such as gold, which readily bonds with the corresponding aluminum contact pads. Thus, such bumps may be utilized to effect electrical interconnection of flexible circuits and rigid circuits, such as printed circuit boards and the like.

When electrically connecting a flexible circuit with a printed circuit board, the bumps of the flexible circuit are pressed firmly against corresponding conductive contact pads of the printed circuit board in order to provide a reliable electrical connection. A clamping system is typically defined by a connector which provides the compression force necessary to maintain the desired mechanical and electrical contact between the bumps and the contact pads. The connector thus facilitates reliable electrical connection of the flexible circuit and the printed circuit board.

It is known to use flexible circuitry to connect printed circuit boards to one another according to various different configurations or relative orientations of the printed circuit boards. According to a first exemplary contemporary configuration, spaced apart, generally coplanar printed circuit boards are bridged or attached to one another via flexible circuitry which extends therebetween, so as to define a jumper. According to a second exemplary contemporary configuration, stacked, generally parallel printed circuit boards are interconnected via flexible circuitry, so as to define a mezzanine. According to a third exemplary configuration, generally orthogonal printed circuit boards are attached to one another via flexible circuitry, so as to define a backplane.

More particularly, according to the contemporary coplanar configuration, two generally coplanar printed circuit boards are electrically interconnected with one another via a flexible circuit which extends in a bridge-like fashion therebetween. Clamping connectors are utilized to attach each end of the flexible circuit to one of the printed circuit boards by urging contact bumps of the flexible circuit toward corresponding contact pads formed upon each printed circuit board.

Such contemporary clamping connectors each generally comprise two elongated clamp members between which one end of the flexible circuit and a portion of the printed circuit board are sandwiched, such that when fasteners are used to draw the two elongated clamp members toward one another, the flexible circuit and the printed circuit board are compressed between the two elongated clamp members. In this manner, the conductive bumps of the flexible circuit are brought into intimate mechanical contact with the complimentary pads of the printed circuit board.

According to the contemporary parallel configuration, the two printed circuit boards are positioned in a stacked configuration, e.g., one above the other, and a spacer (along with the flexible circuit and two printed circuit boards) is disposed between two elongated clamp members of a single clamp. The spacer maintains the two printed circuit boards a desired distance from one another. Thus, in the parallel configuration, a single clamp effects desired electrical contact between the first printed circuit board and a first end of the flexible circuit, as well as between the second printed circuit board and a second end of the flexible circuit.

According to the contemporary orthogonal configuration, the spacer is configured so as to position the two printed circuit boards generally at right angles with respect to one another. Each of two separate clamp members independently clamps one of the two printed circuit boards and one end of the flexible circuit to a common spacer. That is, one of the two clamp members clamps one printed circuit board and one end of the flexible circuit to the spacer and the other of the two clamp members clamps another printed circuit board and the other end of the flexible circuit to the same spacer. The spacer is configured so at to orient the two printed circuit boards generally orthogonal to one another when the two printed circuit boards are clamped to the spacer.

Thus, according to contemporary practice, a variety of different configurations of connectors or clamp members are required in order to facilitate the interconnection of printed circuit boards at various different desired orientations with respect to one another.

One disadvantage commonly associated with such contemporary connectors is the need to manufacture a separate, custom spacer for each unique application which requires a spacer. For example, when it is desired to electrically connect two parallel printed circuit boards to one another in a mezzanine fashion, a particular, unique spacer must be fabricated which provides the desired orientation and spacing of the two printed circuit boards relative to one another. Similarly, when it is desired to position two printed circuit boards orthogonal to one another in a backplane fashion, it is necessary to fabricate a spacer which facilitates the desired orthogonal positioning of the printed circuit boards.

Moreover, it is expensive to fabricate such custom spacers and it is expensive and inconvenient to maintain an inventory of such unique spacers in an attempt to anticipate common printed circuit board mounting configurations.

Another disadvantage associated with such contemporary connectors is the relatively high material cost of the spacer. The spacer in such contemporary clamping systems is fabricated from metal. As those skilled in the art will appreciate, the fabrication of spacers from metal is undesirably time consuming and expensive. Frequently, such metal spacers are individually machined.

In view of the foregoing, it is desirable to provide a connecting system which facilitates the electrical interconnection of printed circuit boards and the like utilizing a flexible circuit, wherein at least some portion of each connector is standardized such that the standardized portions may be utilized in a variety of different connector configurations so as to reduce inventory requirements. It is also desirable to provide a connecting system wherein the use of lower cost materials is facilitated.

SUMMARY OF THE INVENTION

In accordance with the principles of the present invention, an electrical connector for interconnecting printed circuit boards and the like with flexible circuitry and for mounting printed circuit boards and the like at desired positions relative to one another is provided.

Although the present invention is described and illustrated herein as effecting the interconnection of two printed circuit boards, such is by way of example only and not by way of limitation. Those skilled in the art will appreciate that various different, generally rigid, electronic devices may be interconnected using the connecting system of the present invention.

The clamping system of the present invention comprises an inboard clamp member which has a body configured to cooperate with a generally complimentary outboard clamp member, so as to capture a portion of at least one printed circuit board and a portion of a flexible circuit between the inboard clamp member and the outboard clamp member in a manner which facilitates electrical connection of the printed circuit board and the flexible circuit. The body of the inboard clamp member is also advantageously configured to facilitate attachment of a spacer thereto. The spacer also has a body and is configured to facilitate desired positioning of the two printed circuit boards with respect to one another. Preferably, attachment of the body of the inboard clamp member and the spacer to one another is accomplished via a latch, such that the body and the spacer can be conveniently snapped together during a simple assembly process. The latch is preferably formed such that the inboard clamp member and the spacer can be simply snapped together.

According to the present invention, the spacer of the clamping system is an interchangeable element (with respect to the inboard and orthogonal clamp members) which is used to facilitate desired positioning of two printed circuit boards or the like with respect to one another. The spacer is attached to two inboard clamp members, so as to facilitate mechanical attachment of two printed circuit boards to one another, as well as to facilitate electrical communication between the two printed circuit boards via a flexible circuit. The configuration of the spacer determines the relative position of the two printed circuit boards which are mechanically attached to one another therewith. Thus, by selecting a spacer having a desired configuration, the spacing, angle and/or orientation of the two printed circuit boards relative to one another is defined.

It is important to note that spacers can be configured so as to have various thicknesses, which provide various relative spacings of the two printed circuit boards in the parallel configuration, for example. The spacer can also be formed so as to have various different angles between the first and second inboard clamp members attached thereto, so as to similarly provide various different angles between two printed circuit boards mechanically attached to one another therewith, such as in the orthogonal configuration, for example.

As those skilled in the art will appreciate, the clamping system of the present invention advantageously provides an improved method and device for electrically connecting two printed circuit boards with a flexible circuit (and consequently for connecting the printed circuit boards with one another). The maintenance of a comparatively standard inventory improved, so as to desirably reduce manufacturing and inventory costs. The inboard and outboard clamp members are standardized and are therefore usable in all these basic configurations, e.g., coplanar, parallel and orthogonal. Different spacers are required for the parallel and orthogonal configurations and no spacer is required for the coplanar configuration. Assembly costs are reduced by facilitating simple snap-together construction of the inboard clamp members and the spacer.

Thus, according to the present invention, a spacer may be specifically configured to facilitate the electrical interconnection of two printed circuit boards which are oriented generally parallel to one another, which are oriented generally orthogonal to one another, as well as which are disposed at various other angles and/or orientations with respect to one another. Indeed, the inboard and outboard clamp members may be used without a spacer, so as to facilitate the interconnection of two printed circuit boards which are at various angles and/or orientations with respect to one another. Of course, when omitting the spacer some other means for maintaining the desired mechanical mounting of the printed circuit boards must be provided.

Since the use of an interchangeable spacer facilitates the mounting of printed circuit boards at various different orientations with respect to one another, the need for custom mounting and/or clamping hardware is mitigated. Thus, rather than having a comparatively larger inventory containing a dedicated or custom clamp assembly for each desired orientation of printed circuit boards, an inventory containing only standard inboard and outboard clamp members and the desired variety of spacers may be provided instead.

Further, the use of such interchangeable spacers generally facilitates fabrication of the spacers utilizing less expensive materials, thereby desirably lowering the overall cost of the connector. Typically, such connectors, including any spacing component thereof, have been fabricated from metal, so as to provide the desired structural strength and durability. However, according to the present invention, the inboard and outboard clamping members may be fabricated from metal and the spacer can be fabricated from a less expensive material, such as plastic.

As those skilled in the art will appreciate, the inboard and outboard clamping members are portions of the connector assembly which are generally subject to higher stress than the spacer. Indeed, in those applications wherein the printed circuit boards are generally parallel with respect to one another, the spacer is subjected mostly to a compressive force, which does not require substantial structural strength. The inboard and outboard clamp members mitigate, spread or relieve a substantial portion of the stress applied to the spacer. Therefore, while it is generally necessary that the inboard and outboard spacers be fabricated of a durable material such as metal, according to the present invention the spacer may generally be formed of a less durable material such as plastic.

These, as well as other advantages of the present invention, will be more apparent from the following description and drawings. It is understood that changes in the specific structure shown and described may be made within the scope of the claims without departing from the spirit of the invention.

DETAILED DESCRIPTION OF THE INVENTION

The detailed description set forth below in connection with the appended drawings is intended as a description of the presently preferred embodiments of the invention and is not intended to represent the only forms in which the present invention may be constructed or utilized. The description sets forth the functions of the invention and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

More particularly, the present invention comprises an electrical connector or clamping system which facilitates electrical connection between a printed circuit board and flexible circuit so as to effect the electrical interconnection of two printed circuit boards or the like. The present invention may, in some embodiments, also facilitate mechanical attachment of two printed circuit boards or the like to one another.

Figure 8:
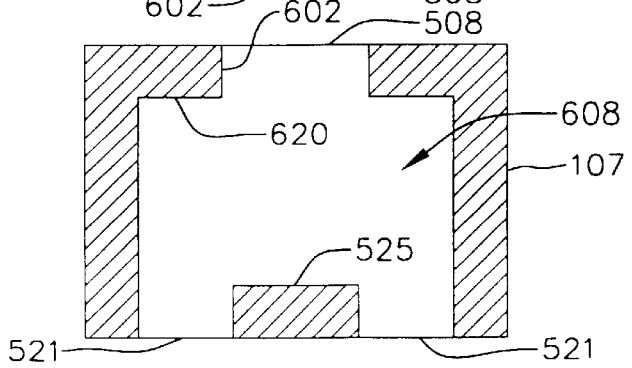
FIG. 8 is a semi-schematic cross-sectional view of the lower inboard clamp member of FIG. 5, taken along line 8 thereof.
Figure 9:
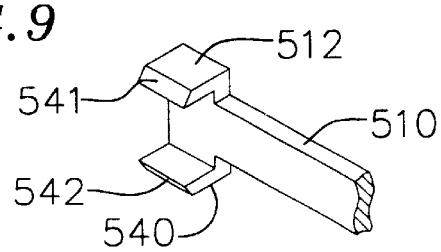
FIG. 9 is a semi-schematic perspective view showing a male detent of the latch of the spacer of FIG. 5.
Figure 10:
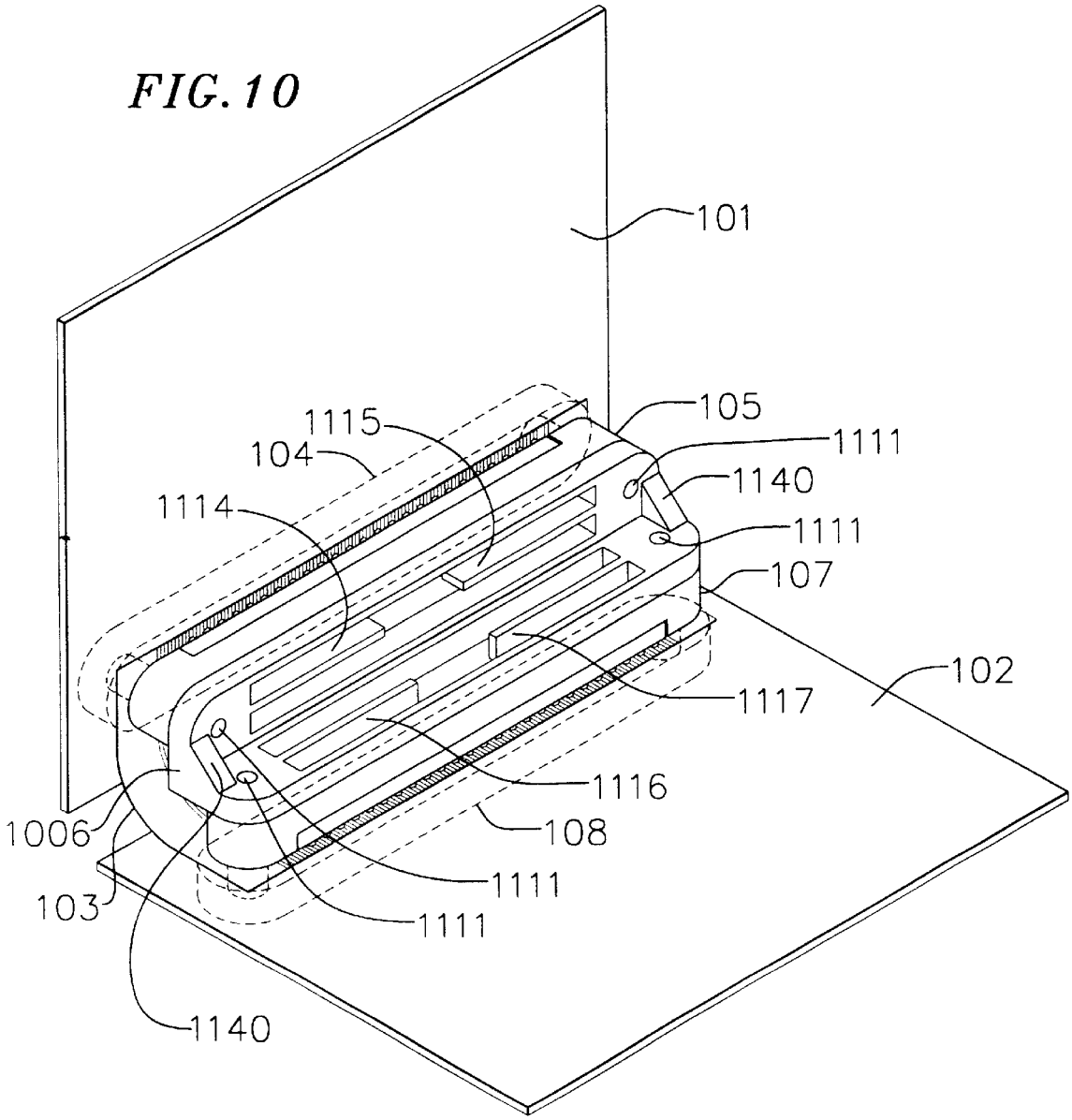
FIG. 10 is a semi-schematic perspective view showing an electrical connector assembly in accordance with a second embodiment of the present invention, wherein two generally orthogonal printed circuit boards are electrically interconnected by a flexible circuit.
Figure 11:
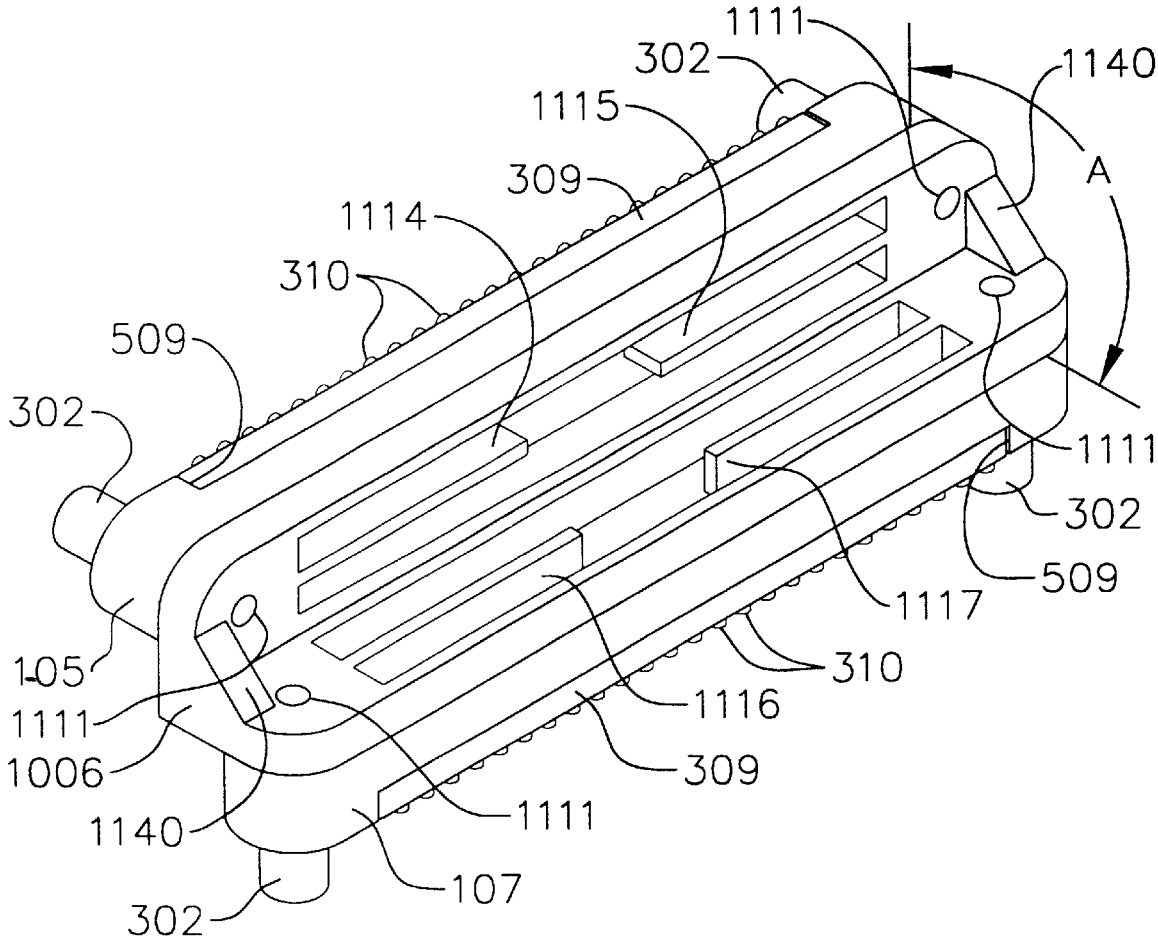
FIG. 11 is a semi-schematic enlarged perspective view of the orthogonal spacer/inboard clamp member assembly of FIG. 10.
Figure 12:
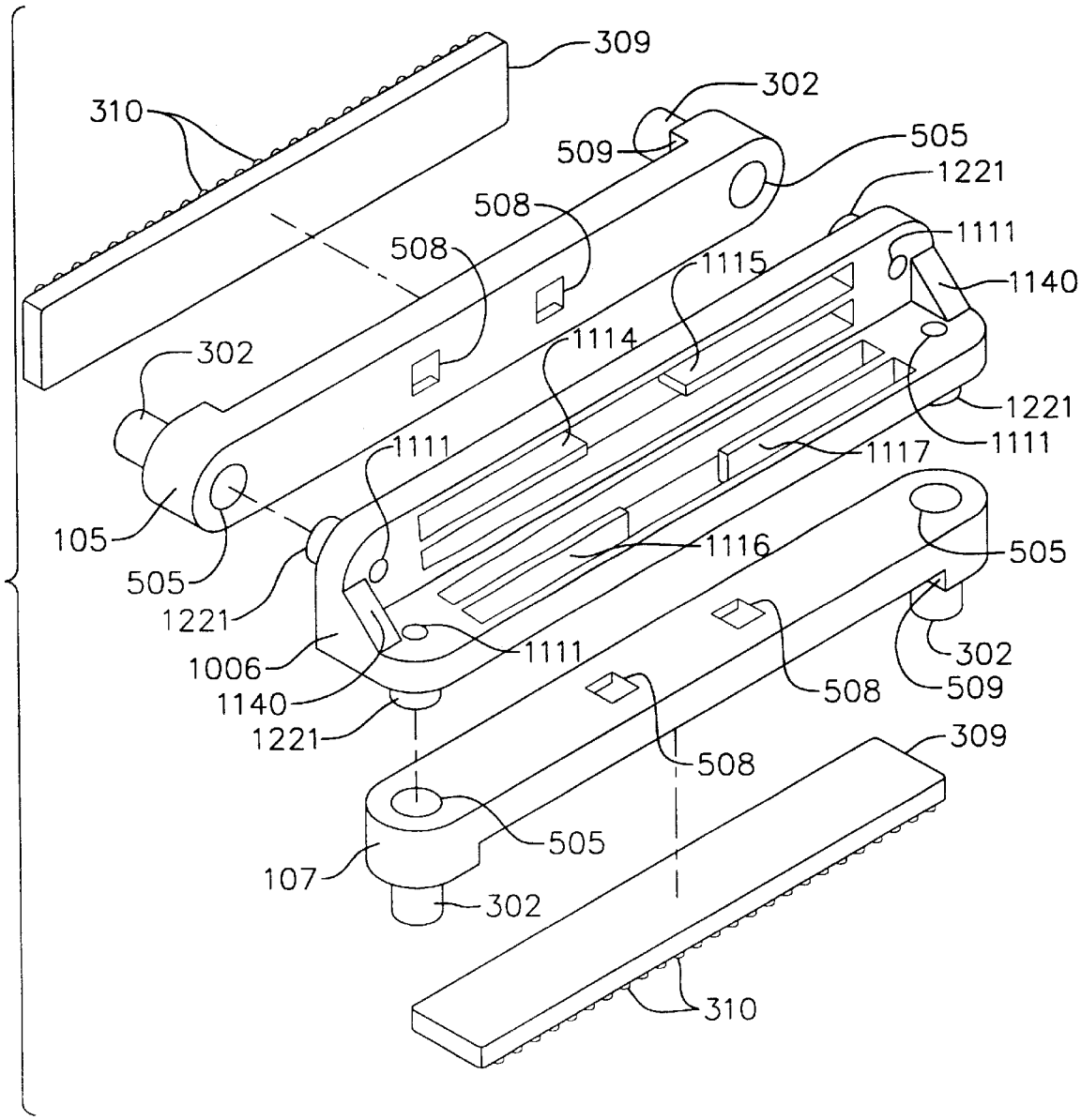
FIG. 12 is a semi-schematic exploded perspective view of the orthogonal spacer/inboard clamp member assembly of FIG. 10.
Figure 13:
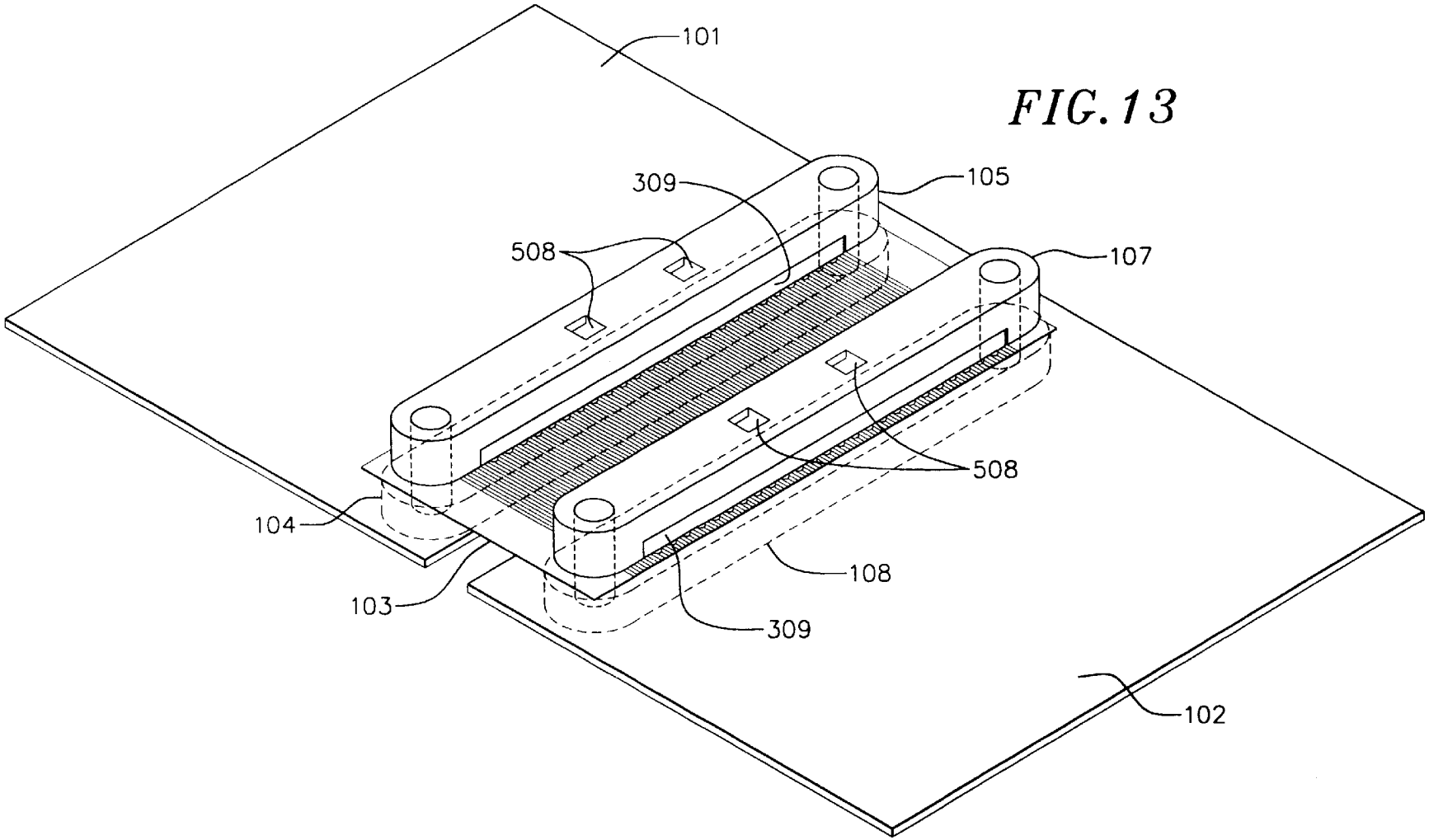
FIG. 13 is a semi-schematic perspective view showing an electrical connector assembly in accordance with a third embodiment of the present invention, wherein two generally coplanar printed circuit boards are electrically interconnected by a flexible circuit.

A first embodiment of the present invention is shown in FIGS. 1–9, a second embodiment of the present invention is shown in FIGS. 10–12 and a third embodiment of the present invention is shown in FIG. 13. According to the first embodiment of the present invention, two generally parallel printed circuit boards are electrically interconnected utilizing a modular, snap-together, mezzanine-type connector (as used herein, a mezzanine-type connector is defined as a connector which has a spacer that is configured to separate two generally parallel, stacked printed circuit boards) and a flexible circuit. According to the second embodiment of the present invention, two generally orthogonal printed circuit boards are electrically interconnected utilizing a modular, snap-together, right angle connector and a flexible circuit. According to the third embodiment of the present invention, two generally coplanar printed circuit boards are electrically interconnected utilizing inboard and outboard clamp members and a flexible circuit, but without using a spacer.

Figure 1:
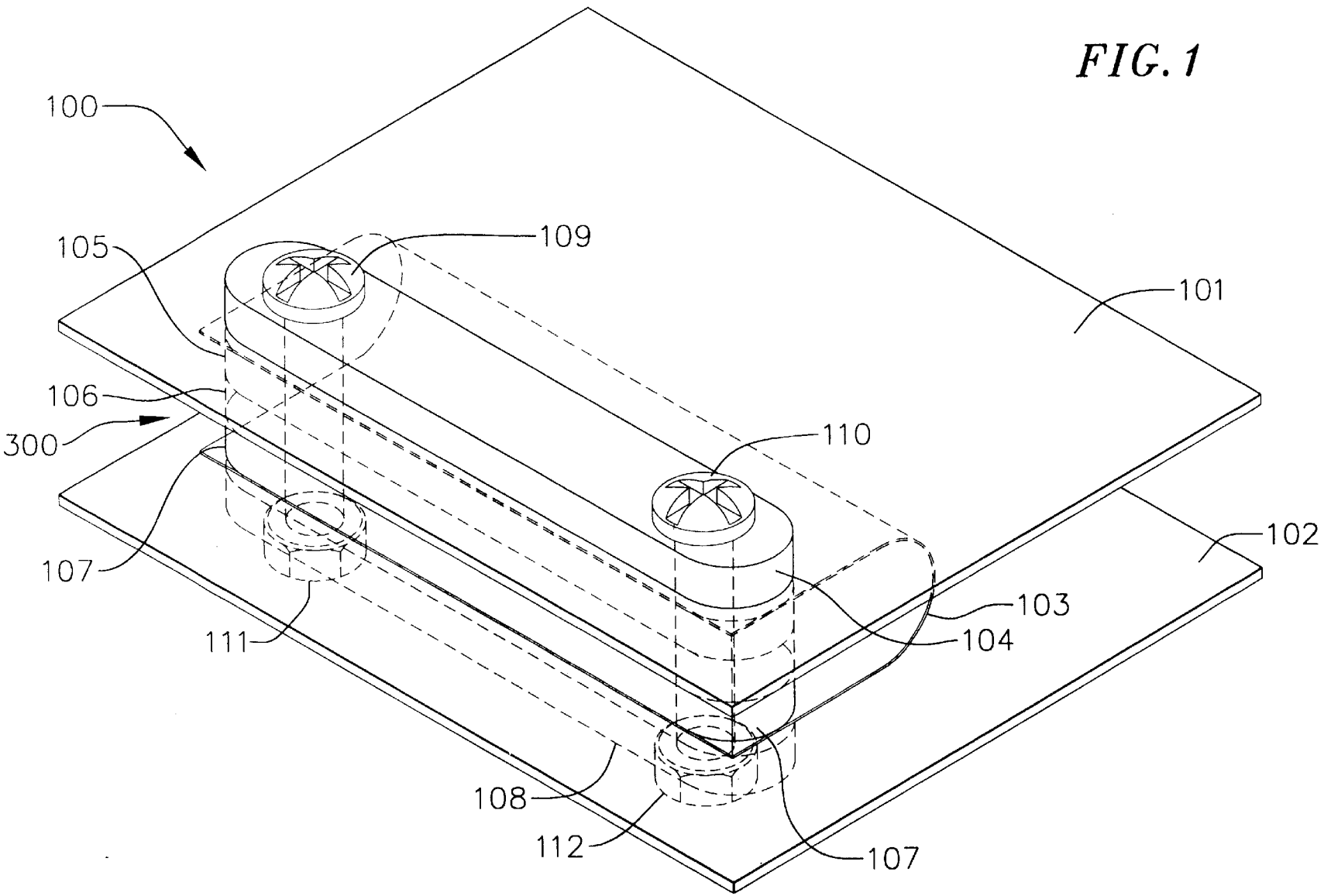
FIG. 1 is a semi-schematic perspective view showing an electrical connector assembly in accordance with a first embodiment of the present invention, wherein two generally parallel printed circuit boards are electrically interconnected by a flexible circuit.
Figure 2:
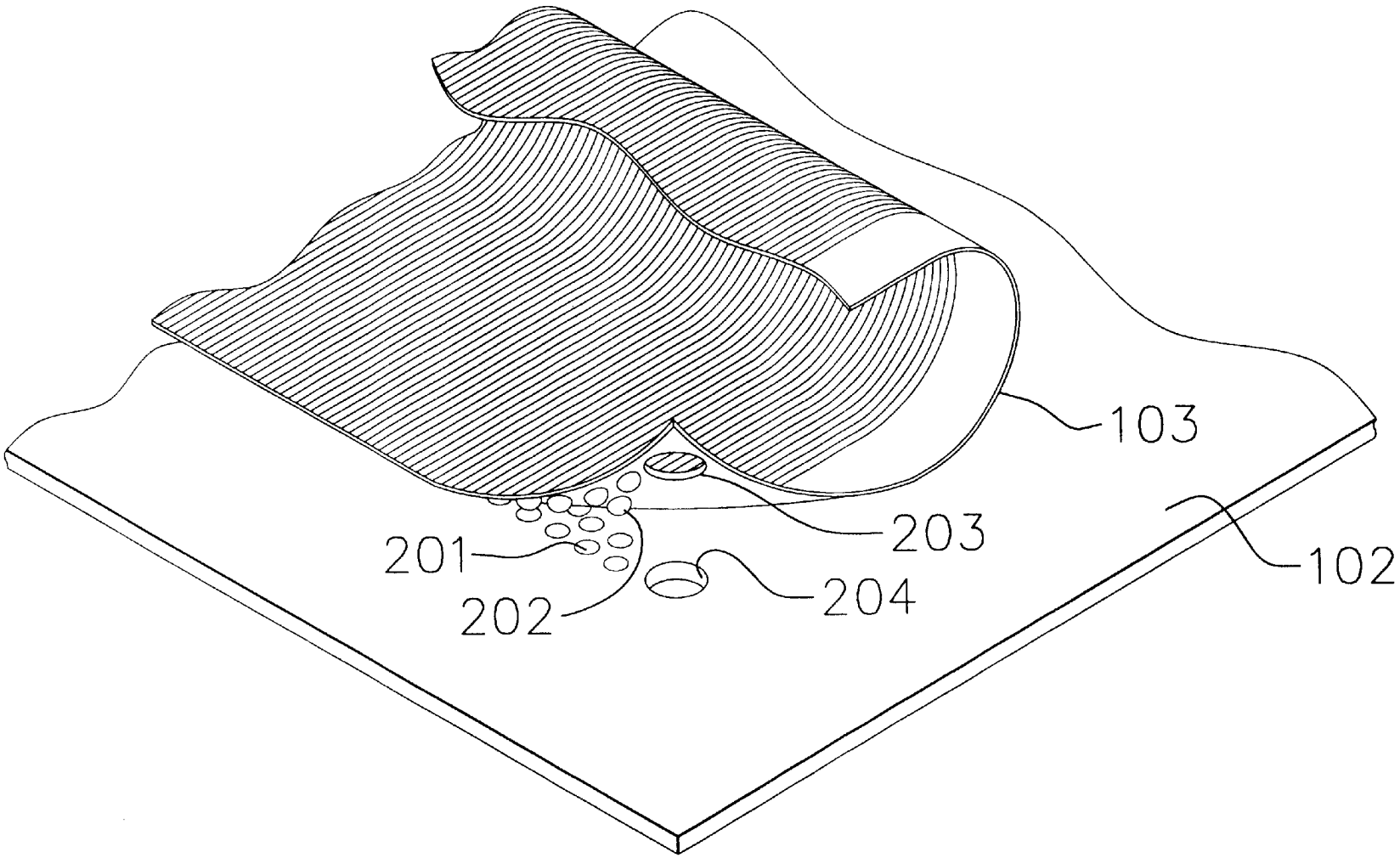
FIG. 2 is a semi-schematic enlarged fragmentary perspective view showing a portion of the lower printed circuit board of FIG. 1, wherein the flexible circuit which is electrically connected therewith has a corner peeled upwardly so as to reveal the conductive bumps of the flexible circuit and the corresponding contact pads of the printed circuit board.
Figure 3:
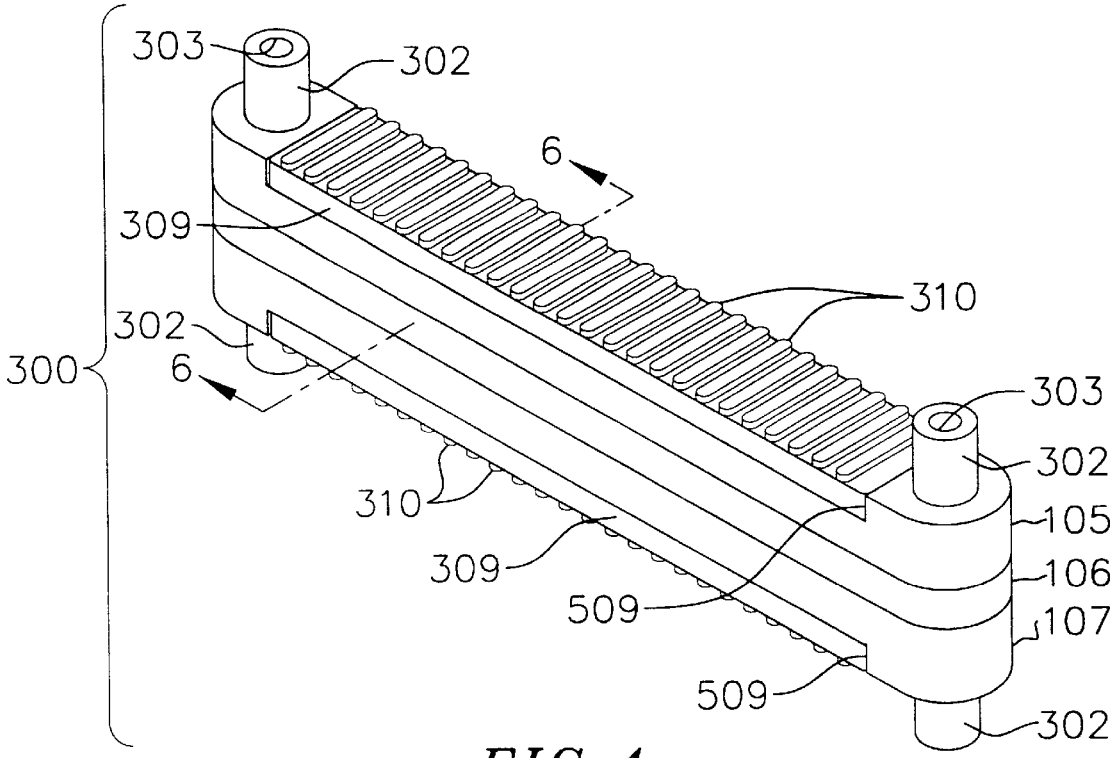
FIG. 3 is a semi-schematic perspective view showing the stacked assembly (comprised of a spacer and two attached inboard clamp members) of FIG. 1.
Figure 4:
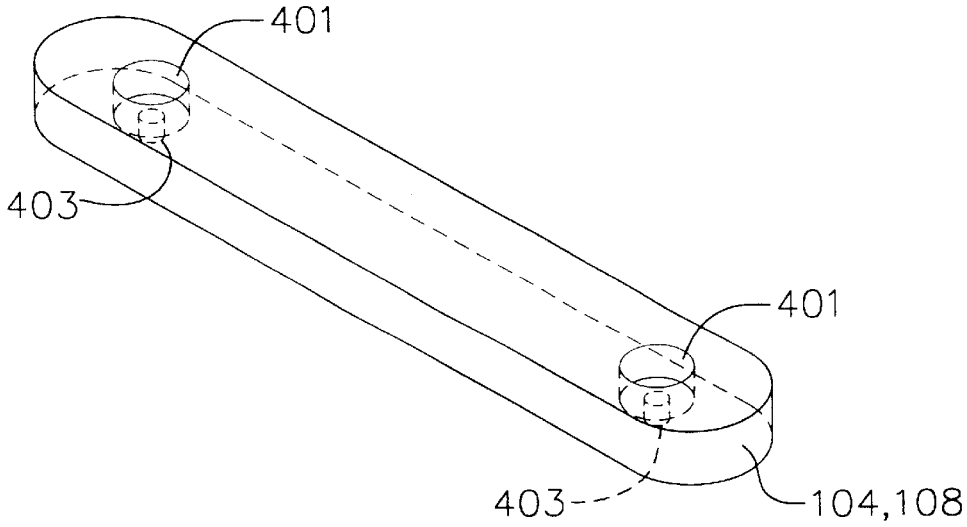
FIG. 4 is a semi-schematic perspective view showing one of the outboard clamp members of FIG. 1.
Figure 5:
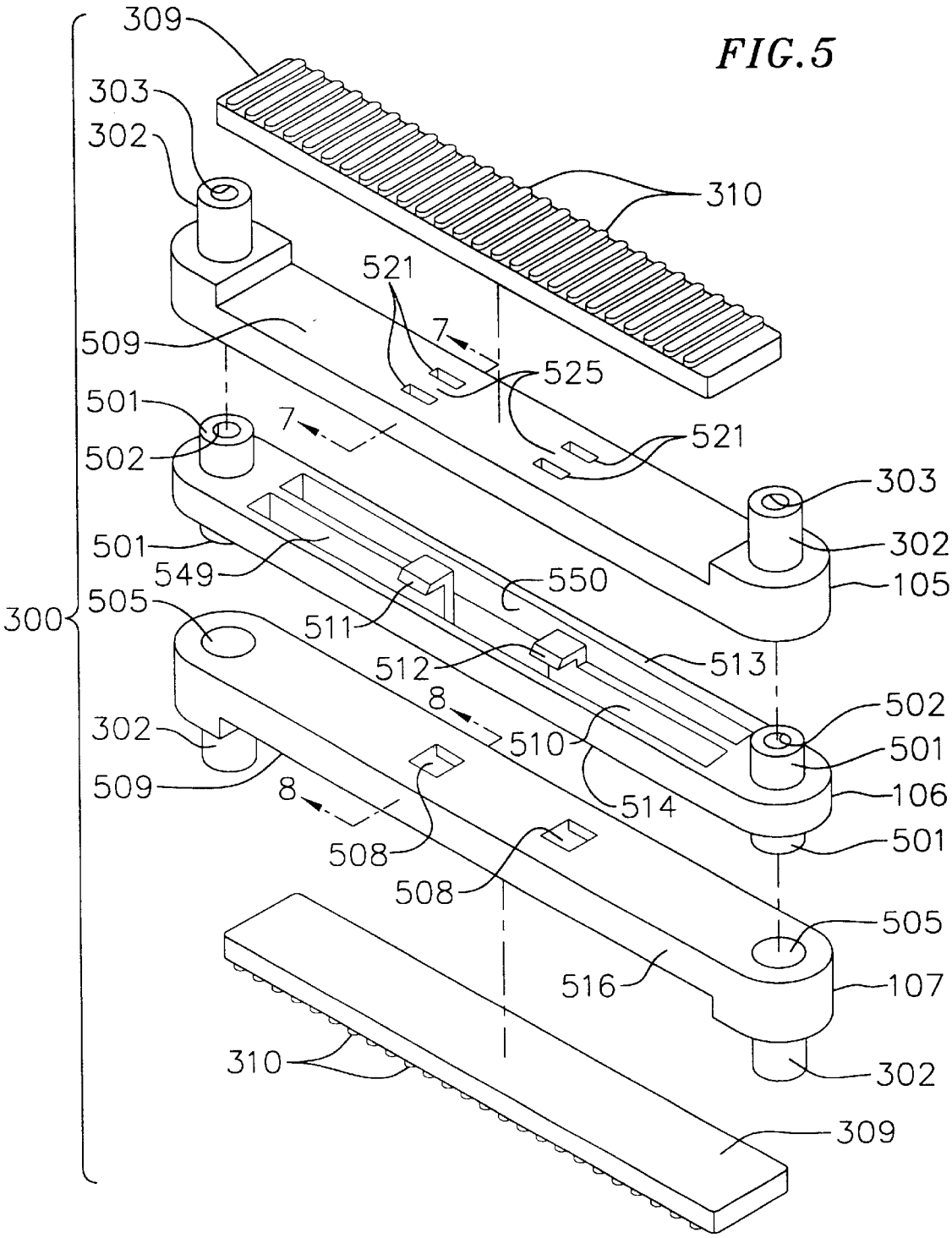
FIG. 5 is a semi-schematic exploded perspective view of the stacked assembly of FIG. 3.

Referring now to FIGS. 1–9, a printed circuit board and connector assembly 100 comprises two generally parallel printed circuit boards 101 and 102, a flexible circuit 103, two outboard clamp members 104 and 108 (best shown in FIG. 4) and a stacked assembly 300 (best shown in FIGS. 3 and 5). Electrical connection between the two printed circuit boards 101 and 102 is facilitated by a mezzanine-type connector which comprises the stacked assembly 300, the two outboard clamp members 104 and 108 and the flexible circuit 103. The flexible circuit 103 electrically interconnects the two printed circuit boards 101 and 102 and is held in place by clamping action which is provided by the cooperation of the stacked assembly 300 and the two opposed outboard clamp members 104 and 108. Each of the two outboard clamp members 104 and 108 is preferably generally complimentary in shape and configuration with respect to corresponding portions, i.e., the inboard clamp members 105 and 107, of the stacked assembly 300, as discussed in detail below.

However, those skilled in the art will appreciate that the outboard clamp members 104 and 108 (as well as the inboard clamp members 105 and 107) may be formed so as to have various different shapes and configurations. Thus, the present invention contemplates any shape or configuration of the outboard clamp members 104 and 108 and the inboard clamp members 105 and 107 which is suitable for applying pressure to the two printed circuit boards 101 and 102 and the two ends of the flexible circuit 103 in a manner which maintains the relative positions or alignment of each of the two printed circuit boards 101, 102 and the flexible circuit 103 and also in a manner which assures adequate contact of the flexible circuit 103 with the printed circuit boards 101 and 102.

Clamping pressure is applied to the two outboard clamp members 104 and 108 such that the two outboard clamp members 104 and 108 in turn apply clamping pressure to the two printed circuit boards 101 and 102, the flexible circuit 103 and the stacked assembly 300. The clamping pressure is preferably applied may be provided, for example, via fasteners such as bolts 109 and 110 along with corresponding nuts 111 and 112. As those skilled in the art will appreciate, tightening the nuts 111 and 112 upon their respective bolts 109 and 110 causes the outboard clamp members 104 and 108 to move inboard, i.e., toward one another. In moving toward one another, the outboard clamp members 104 and 108 urge the ends of the flexible circuit 103 into intimate contact with the printed circuit boards 101 and 102.

The bolts 109 and 110 and their corresponding nuts 111 and 112 thus hold the printed circuit board and connector assembly 100 together. However, those skilled in the art will appreciate the various other means for applying such clamping pressure and for holding the printed circuit board and connector assembly 100 together are likewise suitable. Various different clamp and/or spring assemblies are contemplated. Thus, for example, spring clips and/or C clamps, which apply inboard pressure to the two outboard clamp members 104 and 108 or to the two printed circuit boards 101 and 102 may alternatively be utilized.

One alternative means for applying such clamping pressure to hold the printed circuit board and connector assembly 10 together is to thread the bores 502 (FIG. 5) of the bosses 501 of the spacer 106 such that screws, bolts, or other threaded fasteners are insertable through the bores 303 of the bosses 302 of the clamp members 105 and 107. Thus, such threaded fasteners may be utilized to hold the printed circuit board and connector assembly 10 together.

With particular reference to FIG. 2, electrical connection between the flexible circuit 103 and each printed circuit board 101 and 102 is facilitated by bump contacts 202 formed at each end of the flexible circuit 103 and complimentary contact pads 201 formed upon each of the two printed circuit boards 101 and 102. The bump contacts 202 and the contact pads 201 are preferably each formed so as to define a generally similar array, such that when aligned and pressed together, the bump contacts 202 fuse slightly with the contact pads 201, according to well-known principles.

The bump contacts 202 are preferably formed of a malleable metal, such as lead, solder, copper, silver or gold and the contact pads 201 are preferably formed of a highly conductive metal such as copper or aluminum. Those skilled in the art will appreciate that various different shapes, configurations and types of material are suitable for forming the bump contacts 202 and the contact pads 201.

Examples of methods for the construction of such bump contacts are disclosed in U.S. Pat. No. 5,245,750, issued on Sep. 21, 1993 to Crumly et al. and entitled METHOD OF CONNECTING A SPACED IC CHIP TO A CONDUCTOR AND THE ARTICLE THEREBY OBTAINED, and in U.S. Pat. No. 5,790,377, issued on Aug. 4, 1998 to Schreiber et al. and entitled INTEGRAL COPPER COLUMN WITH SOLDER BUMP FLIP CHIP, the contents of both of which are hereby incorporated by reference.

One opening 203 is formed at each corner of the flexible circuit 103. Each opening 203 is positioned so as to cooperate with a corresponding opening 204, two of which are formed in one end of each printed circuit board 101 and 102, in order to facilitate alignment of the flexible circuit 103 with each of the two printed circuit boards 101 and 102 by receiving the bosses 302 of the inboard clamp members 105 and 107 into the openings 203 and 204. Such alignment of the printed circuit boards 101 and 102 with respect to the flexible circuit 103 is necessary to facilitate compression of the stacked assembly 300 in a manner which facilitates desired electrical interconnection of the printed circuit boards 101 and 102.

With particular reference to FIG. 3, the stacked assembly 300 comprises two spaced apart and oppositely oriented inboard clamp members 105 and 107, which are separated by a spacer 106. Each of the two inboard clamp members 105 and 107 are preferably identical with respect to one another. According to the present invention, the inboard clamp members 105 and 107 are both configured to snap to the spacer 106, so as to define the stacked assembly 300. Thus, easy, convenient and low cost assembly of the stacked assembly 300 (and consequently of the entire printed circuit board and connector assembly 100) is facilitated.

As discussed above, the inboard clamp members 105 and 107 are configured to facilitate the aligned positioning of the printed circuit boards 101 and 102 and the ends of the flexible circuit 103 between the outboard surfaces of the inboard clamp members 105 and 107 and the inboard surfaces of the outboard clamp members 104 and 108, in order to facilitate holding the entire printed circuit board and connector assembly 100 together and also in order to facilitate the desired application of compression thereto.

Each inboard clamp member 105 and 107 preferably comprises a depression or cut-out 509 within which an elastomeric pad 309 is disposed. The elastomeric pad 309 assure that compressive forces are applied generally evenly so the individual bump contacts 202 of the flexible circuit 103. Preferably, each elastomeric pad 309 comprises a plurality of transverse, generally parallel, elongate protuberances 310 extending outboard therefrom, so as to apply a compressive force to the bump contacts 202 of the flexible circuit 103. However, those skilled in the art will appreciate that various other configurations of the elastomeric pad 309 are likewise suitable and that the inboard clamp members 105 and 107 may optionally be formed without any elastomeric pad at all.

Preferably, each inboard clamp member 105 and 107 comprises a boss 302 formed upon either end thereof and extending in an outboard direction when the inboard clamp members 105 and 107 are attached to the spacer 106. The bosses 302 are configured to be received within complimentary bores 401 formed at each end of the outboard clamp members 104 and 108. Thus, the bosses 302 are inserted into the complimentary bores 401 of the outboard clamp members 104 and 108 so as to maintain desired alignment of the outboard clamp members 104 and 108 with respect to the stacked assembly 300. The bosses 302 are also inserted through the openings 203 of the flexible circuit 103 and the openings 204 of the printed circuit boards 101 and 102, so as to maintain desired alignment thereof, as discussed above. Thus, the bosses 302 are sized to be snugly received within complimentary openings 204 formed within each of the first 101 and second 102 circuit boards and similarly to fit snugly within complimentary openings 203 of the flexible circuit 103, so as to facilitate such alignment.

According to the preferred embodiment of the present invention, each boss 302 comprises a bore 303 which extends completely through the inboard clamp member 105, 107, so as to facilitate the use of fasteners, such as bolts 109 and 110 and their respective nuts 111 and 112 (FIG. 1).

The spacer 106 has bores 502 (FIG. 5) formed therein, such that the bolts 109 and 110 may extend completely through the stacked assembly 300. Thus, the bolts 109 and 110 extend through the bores 403 and 401 (FIG. 4) of the outboard clamp members 104 and 108, the bores 303 of the inboard clamp members 105 and 107 and the bores 502 of the spacer 106, as well as through the openings 203 of the flexible circuit 103 and the openings 204 of the printed circuit boards 101 and 102.

With particular reference to FIG. 4, the bores 401 of the outboard clamp members 104 and 105 which receive the bosses 302 of the clamp members 105 and 107 are preferably coaxially aligned with respect to the smaller bores 403 which receive the bolts 109 and 110.

Figure 7:
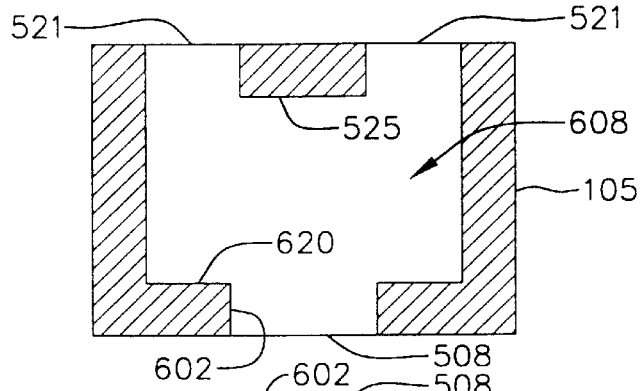
FIG. 7 is a semi-schematic cross-sectional view of the upper inboard clamp member of FIG. 5, taken along line 7 thereof.

With particular reference to FIGS. 5–9, the preferred method by which the inboard clamp members 105 and 107 attach to the spacer 106 is shown. The inboard clamp members 105 and 107 attach to the spacer 106 via latches defined by male snap detents 511, 512, 540 and 607 (512 and 540 of which are shown in FIG. 9) formed upon the spacer 106 and corresponding female snap detents 602 formed upon each of the inboard clamp members 105 and 107.

Bosses 501 of the spacer 106 are received within complimentary bores 505 of the inboard clamp members 105 and 107 to facilitate alignment of the inboard clamp members 105 and 107 with respect to the spacer 106.

More particularly, the spacer 106 comprises first 549 and second 510 inwardly extending fingers formed within a cavity 550 defined by elongate longitudinal members 513 and 514. The first 549 and second 510 fingers have male detents 511, 512, 540 and 607 formed upon the distal ends thereof. Preferably, each finger 549 and 510 has two male detents formed upon the distal end thereof, so as to facilitate the connection of two inboard clamp members 105 and 107 to the spacer 106. That is, the first finger 549, for example, has an upper male detent 511 formed at an upper end portion thereof and also has a lower male detent 607 (FIG. 6) formed at a lower end portion thereof. The lower male detent 607 is similar in structure and function to the upper male detent 511. Thus, one inboard clamp member 105 may be attached to the upper surface of the spacer 106 via upper male detents 511 and 512, while another inboard clamp member 107 is attached to the lower surface of the spacer 106 via the lower male detents 540 (FIG. 9) and 607 (FIG. 6).

Each of the inboard clamp members 105 and 107 have openings 508 formed therein, such that the male detent members 511, 512, 540 and 607 may be received within the openings 508 in a manner which attaches the inboard clamp members 105 and 107 to the spacer 106.

Figure 6:
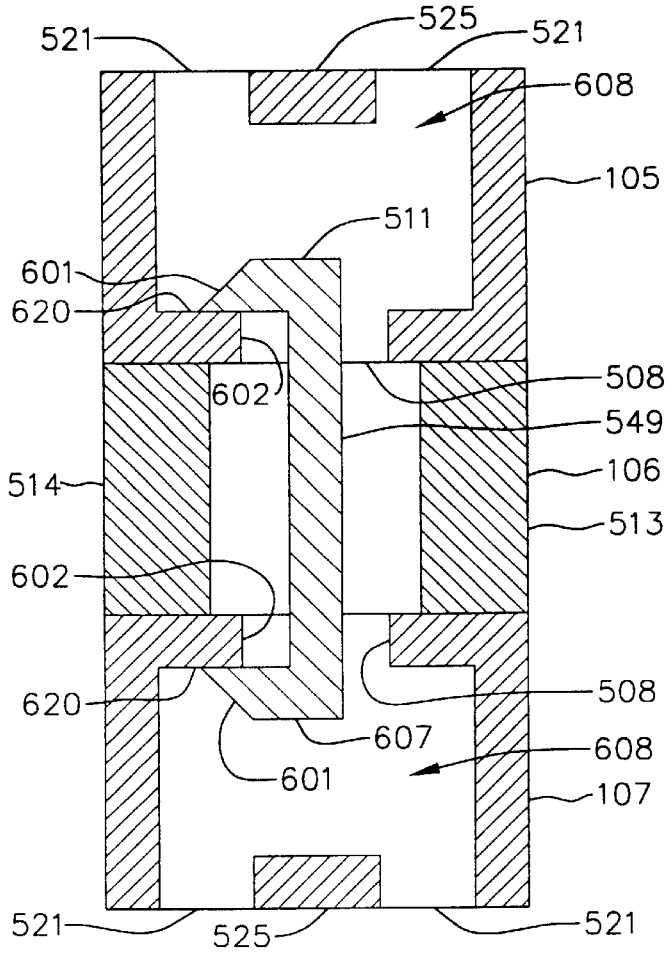
FIG. 6 is a semi-schematic cross-sectional view of the stacked assembly taken along line 6 of FIG. 3, showing the first and second inboard clamp members snapped to the spacer using the latching system of the present invention.

With particular reference now to FIGS. 6–8, attachment of the inboard clamp members 105 and 107 to the spacer 106 via the male detents 511 and 607 of finger 549 is shown in detail. Each of the male detents 511, 607, 512 and 540 comprises a ramp 601 which cams against a camming surface 602 of the corresponding female detent or opening 508 to facilitate attachment of the inboard clamp members 105 and 107 to the spacer 106. Thus, to facilitate attachment of the inboard clamp members 105 and 107 to the spacer 106, the fingers 549 and 510 (FIG. 5) of the spacer 106 deform or bend so as to allow the cam surfaces 601 of the male detents 511 and 607 (as well as the male detents 512 and 540) to slide past the cam surfaces 602 of the female detents or openings 508 of inboard clamp members 105 and 107 until the male detents 511 and 607 (as well as the male detents 512 and 540) are within the cavities 608 of the inboard clamp members 105 and 107. Once the male detents 511 and 607 (as well as the male detents 512 and 540) are within the cavities 608 of the inboard clamp members 105 and 106, then the fingers 549 and 510 spring back into their original or unbent positions, such that the male detent members 511 and 607 engage the inner surface 620 of each cavity 608 in a manner which reliably attaches the spacer 106 to each inboard clamp member 105 and 107.

Openings 521, two pairs of which are separated by strips 525 on each inboard clamp member 105 and 107, facilitate inexpensive manufacturing of the inboard clamp members 105 and 107 via a conventional injection molding process. Protrusions from one mold cavity extend through openings 508 and protrusions from the opposition mold cavity extend through opening 521 in order to define the cavities 608 during the injection molding process. Those skilled in the art will appreciate various different processes for manufacturing each of the components of the present invention may likewise be suitable.

The outboard clamp members 104 and 108, the inboard clamp members 105 and 107, and the spacer 106 are preferably all defined by elongate bodies which are similarly shaped with respect to one another.

Spacers having various different thicknesses and/or configurations may be provided so as to facilitate the mechanical attachment of printed circuit boards or the like to one another at various different distances and/or orientations. One example of a spacer which provides mechanical attachment of two printed circuit boards to one another at a different orientation from the orientation shown in FIG. 1 is provided by the spacer 1006 of the second embodiment of the present invention, as shown in FIGS. 10–12.

Referring now to FIGS. 10–12, the second embodiment of the present invention is generally analogous to the first embodiment thereof, with the exception that the spacer 1006 of the second embodiment is formed so as to facilitate attachment of two printed circuit boards 101 and 102 to one another such that the two printed circuit boards 101 and 102 are oriented generally orthogonally with respect to one another. Thus, the two surfaces of the spacer 1006 to which the inboard clamp members 105 and 107 attach to the spacer 1006 are formed at approximately right angles to one another.

It is important to recognize that spacers of the present invention may be formed to provide any desired angle (angle A of FIG. 11 and also may be formed so as to provide any desired spacing between the printed circuit boards attached together therewith. Thus, according to the present invention two printed circuit boards may be attached to one another at any desired distance and orientation with respect to one another.

According to the second embodiment of the present invention, the outboard clamp members 104 and 108, the inboard clamp members 105, 107 and the flex circuit 103 are substantially identical to the corresponding components of the first embodiment of the present invention. Thus, only the spacer 1006 is substantially different between the first and second embodiments of the present invention. Such standardization of the components of the first and second embodiments of the present invention facilitates reduced inventory requirements by providing a small number of standardized parts which cooperate with one another to facilitate the attachment of two printed circuit boards to one another in a large variety of different configurations. As suck, only the spacer 1006 needs to be varied in order to vary the desired configuration of the printed circuit boards.

As in the first embodiment of the present invention, the spacer 1006 of the second embodiment comprises a plurality of fingers 1114, 1115, 1116 and 1117. Each finger 1114, 1115, 1116 and 1117 comprises a single male detent similar in structure and functionality to 511 of FIG. 5 (although it is worthwhile to note that each finger 549 and 510 of the first embodiment of the present invention has two male detents (511 and 607) or (512 and 540) formed thereon). The male detents are configured to engage openings 508 in inboard clamp members 105 and 107.

Bores 1111 formed in the spacer 1006 are generally analogous to bores 502 formed in the spacer 106 of the first embodiment of the present invention. Thus, bores 1111 facilitate the use of fasteners such as bolts to effect clamping of the printed circuit boards 101 and 102 to the flexible circuit 103. It is worthwhile to note that according to the first embodiment of the present invention, only two such fasteners are required so as to effect clamping of the printed circuit boards 101 and 102 along with the flexible circuit 103 and the stacked assembly 300, whereas according to the second embodiment of the present invention four fasteners are required since the first printed circuit board 101 is clamped to the flexible circuit 103 independently of the clamping of the second printed circuit board 102 to the flexible circuit 103.

Similarly, the bosses 1221 of the spacer 1006 are generally analogous to the bosses 501 of the spacer 106 (FIG. 5). Thus, the bosses 1221 of the spacer 1006 effect alignment of the spacer 1006 with respect to the inboard clamp members 105 and 107.

Optional gussets 1140 enhance the structural strength of the spacer 1006 and further facilitate fabrication of the spacer from a non-metallic material.

Referring now to FIG. 13, a third embodiment of the present invention utilizes the inboard clamp members 105 and 107, the outboard clamp members 104, 108 and the flexible circuit 103 of the first embodiment of the present invention to effect electrical interconnection of two generally coplanar printed circuit boards 101 and 102. Although a spacer may be utilized in such coplanar interconnection of two printed circuit boards, a spacer is not required. Indeed, the spacer may be eliminated in any of the embodiments of the present invention when another means of mechanical support for the two printed circuit boards is provided.

Thus, according to the present invention, a large degree of flexibility in the mounting and electrical interconnection of printed circuit boards and the like is achieved, while maintaining a generally standardized inventory of connector components. Further, less expensive materials such as plastic may be utilized in at least the spacer of connectors formed according to the present invention, since the spacer is not generally subjected to the higher levels of stress to which the inboard and outboard clamp members are subjected.

It is understood that the exemplary connecting system for printed circuit boards and the like described herein and shown in the drawings represents only presently preferred embodiments of the invention. Indeed, various modifications and additions may be made to such embodiments without departing from the spirit and scope of the invention. For example, the connecting system of the present invention may be utilized to interconnect any desired combination of printed circuit boards, flexible circuits, integrated circuits and hybrid circuits. Further, those skilled in the art will appreciate that the inboard and outboard clamp members, as well as the spacer, may have various different physical configurations. Further, the latches utilized to attach the inboard clamp members to the spacer may have various different forms. Thus, these and other modifications and additions may be obvious to those skilled in the art and may be implemented to adapt the present invention for use in a variety of different applications.

What is claimed is:

1. An electrical connector assembly for electrically connecting two printed circuit boards to one another, the electrical connector assembly comprising:

a spacer;

two outboard clamp members; and two inboard clamp members, each inboard clamp member being configured to cooperate with one of the two outboard clamp members so as to capture a portion of one printed circuit board and a portion of a flexible circuit between the inboard clamp member and the outboard clamp member in a manner which facilitates electrical connection of the printed circuit board and the flexible circuit and wherein each inboard clamp member is also configured to facilitate attachment of the spacer thereto, so as to facilitate desired positioning of the two printed circuit boards with respect to one another.

2. The electrical connector assembly as recited in claim 1, wherein:

the flexible circuit comprises a plurality of contact bumps formed upon each of two ends thereof;

the first printed circuit board comprises a plurality of contact pads formed thereon;

the second printed circuit board comprises a plurality of contact pads formed thereon; and wherein the first printed circuit board and one end of the flexible circuit are captured between a first one of the two outboard clamp members and a first one of the two inboard clamp members and wherein the second printed circuit board and another end of the flexible circuit are captured between a second one of the two outboard clamp members and a second one of the two inboard clamp members.

3. The electrical connector assembly as recited in claim 1, wherein the spacer is configured so as to position two printed circuit boards substantially parallel to one another.

4. The electrical connector assembly as recited in claim 1, wherein the spacer is configured so as to position two printed circuit boards substantially orthogonal to one another.

5. The electrical connector assembly as recited in claim 1, wherein:

the two outboard clamp members are formed of metal;

the two inboard clamp members are formed of metal; and the spacer is formed of plastic.

6. An electrical connector assembly for electrically connecting a flexible circuit to two printed circuit boards comprising:

two clamped bracket assemblies electrically connected together by a flexible circuit;

each clamped bracket assembly comprises a printed circuit board, an inboard clamp member and an outboard clamp member; wherein the inboard clamp member cooperates with the outboard clamp member to capture a portion of the flexible circuit and a portion of the printed circuit board thereinbetween;

the inboard clamp member comprises a first side, a second side, and two bores; wherein each bore is configured to pass a fastener therethrough or receive a fastener therein, and wherein the first side of the inboard clamp member comprises an opening for receiving a male detent and the second side of the inboard clamp member comprises a contact surface for contacting an elastomeric pad, the flexible circuit, or the printed circuit board; and the outboard clamp member comprises two bores, wherein each bore is configured to pass a fastener therethrough or receive a fastener therein.

7. The electrical connector assembly of claim 6, wherein the second side of the inboard clamp member comprises a depression.

8. The electrical connector assembly of claim 6, wherein the two stacked components are in contact with one another by the flexible circuit only.

9. The electrical connector assembly of claim 6, further comprising a spacer and two male detents disposed thereon, and wherein the male detents are configured to mate with the opening located on the first side of the inboard clamp member to thereby secure the inboard clamp member to the spacer.

10. The electrical connector assembly of claim 9, wherein the two stacked components are stacked in a linear configuration with the spacer.

11. The electrical connector assembly of claim 9, wherein the two stacked components are stacked in an orthogonal configuration with the spacer.

12. The electrical connector assembly of claim 9, wherein the two stacked components are stacked in an obtuse configuration with the spacer.

13. The electrical connector assembly of claim 9, wherein the two stacked components are stacked in an acute angle with the spacer.

14. An electrical connector assembly for electrically connecting a flexible circuit to two printed circuit boards comprising two stacked clamp assemblies electrically coupled to one another by a flexible circuit; each stacked clamp assembly comprises an inboard clamp connected to an outboard clamp by a boss and a bore arrangement and a printed circuit board; wherein the inboard clamp and the outboard clamp is held together by a clamping force; and wherein the inboard clamp comprises a first side having an opening for receiving a male detent and a second side having a contact surface for contacting with an elastomeric pad, the flexible circuit, or the printed circuit board.

15. The electrical connector assembly as recited in claim 14 further comprising a spacer and two male detents disposed on the spacer.

16. The electrical connector assembly as recited in claim 15 wherein each male detent is connected to the opening located on the first side of the inboard clamp.

17. The electrical connector assembly as recited in claim 16 wherein the spacer comprises two contact surfaces and wherein each contact surface is in contact with the inboard clamp.

18. The electrical connector assembly as recited in claim 17 wherein the two contact surfaces located on the spacer are at a right angle.

19. The electrical connector assembly as recited in claim 17 wherein the two contact surfaces located on the spacer are at an obtuse angle.

20. The electrical connector assembly as recited in claim 17 wherein the two contact surfaces located on the spacer are at an acute angle.

* * * * *